US011071360B2

(12) United States Patent
Sawatzky et al.

(10) Patent No.: US 11,071,360 B2
(45) Date of Patent: Jul. 27, 2021

(54) COMPOSITE STRUCTURE WITH SEPARATOR FOR COINS AND THE LIKE

(71) Applicant: Monnaie Royale Canadienne/Royal Canadian Mint, Ottawa (CA)

(72) Inventors: Trevor Sawatzky, Winnipeg (CA); Bradley Everton, Winnipeg (CA); Xianyao Li, Ottawa (CA)

(73) Assignee: Monnaie Royale Canadienne/Royal Canadian Mint, Ottawa (CA)

( * ) Notice: Subject to any disclaimer, the term of this patent is extended or adjusted under 35 U.S.C. 154(b) by 0 days.

(21) Appl. No.: 16/981,363

(22) PCT Filed: Mar. 14, 2019

(86) PCT No.: PCT/CA2019/050314

§ 371 (c)(1),
(2) Date: Sep. 16, 2020

(87) PCT Pub. No.: WO2019/173921

PCT Pub. Date: Sep. 19, 2019

(65) Prior Publication Data

US 2021/0045506 A1 Feb. 18, 2021

Related U.S. Application Data

(60) Provisional application No. 62/644,029, filed on Mar. 16, 2018.

(51) Int. Cl.

| | |
|---|---|
| ***G09F 3/02*** | (2006.01) |
| ***A44C 21/00*** | (2006.01) |
| ***G07D 5/08*** | (2006.01) |

(52) U.S. Cl.
CPC ..... *A44C 21/00* (2013.01); *G07D 5/08* (2013.01)

(58) Field of Classification Search
CPC ..... A44C 21/00
(Continued)

(56) References Cited

U.S. PATENT DOCUMENTS

| | | | |
|---|---|---|---|
| 3,968,582 | A | 7/1976 | Jones |
| 4,435,911 | A | 3/1984 | Jones |

(Continued)

FOREIGN PATENT DOCUMENTS

| | | |
|---|---|---|
| AU | 749495 B2 | 6/2002 |
| CA | 2092941 | 10/1993 |

(Continued)

OTHER PUBLICATIONS

International Search Report and Written Opinion for PCT/CA2019/050314, dated Jun. 11, 2019.

(Continued)

*Primary Examiner* — Jamara A Franklin
(74) *Attorney, Agent, or Firm* — Andrus Intellectual Property Law, LLP

(57) ABSTRACT

A composite coin, coin blank, medal or token structure provides an inner stack, an outer ring surrounding the inner stack, and a separator, an authentication method and method of manufacture for the same. The inner stack comprises one or more inserts stacked on top of each other. The separator is disposed between the outer ring and the inner stack separating the outer ring from the inner stack and separating the plurality of inserts from each other.

33 Claims, 16 Drawing Sheets

(58) Field of Classification Search
USPC ..... 40/27.5
See application file for complete search history.

(56) References Cited

U.S. PATENT DOCUMENTS

| | | | | |
|---|---|---|---|---|
| 4,472,891 | A | 9/1984 | Lelpo | |
| 5,094,922 | A | 3/1992 | Lelpo et al. | |
| 5,630,288 | A | 5/1997 | Lasset et al. | |
| 5,676,376 | A | 10/1997 | Valley | |
| 6,021,882 | A | 2/2000 | Juds et al. | |
| 6,044,541 | A | 4/2000 | Truong | |
| 6,112,876 | A | 9/2000 | Juds et al. | |
| 6,189,197 | B1 | 2/2001 | Kim | |
| 7,918,455 | B2 | 4/2011 | Chapet et al. | |
| 9,241,548 | B2 | 1/2016 | Bretz et al. | |
| 2004/0173434 | A1 | 9/2004 | Morita et al. | |
| 2006/0071425 | A1 | 4/2006 | Finch et al. | |
| 2007/0105616 | A1 | 5/2007 | Chapet et al. | |
| 2014/0144751 | A1 | 5/2014 | Bilas et al. | |
| 2014/0295204 | A1* | 10/2014 | Li | A44C 21/00 428/596 |
| 2015/0201721 | A1 | 7/2015 | Meyer-Steffens et al. | |

FOREIGN PATENT DOCUMENTS

| | | | |
|---|---|---|---|
| CA | 2854146 | | 5/2013 |
| CA | 2843770 | | 2/2014 |
| DE | 19841622 | A1 | 3/2000 |
| DE | 102010013148 | | 9/2011 |
| EP | 0444373 | A1 | 9/1991 |
| EP | 1136958 | | 9/2001 |
| EP | 1384413 | A1 | 1/2004 |
| JP | 2006238899 | A | 9/2006 |
| JP | 2014532563 | A | 12/2014 |
| KR | 0144703 | B1 | 8/1998 |
| WO | 2014019593 | A1 | 2/2014 |
| WO | 2014019961 | | 2/2014 |
| WO | 2017157667 | A1 | 9/2017 |
| WO | 2017220320 | A1 | 12/2017 |

OTHER PUBLICATIONS

Response to the Written Opinion dated Mar. 9, 2020.
Notice of Allowance for corresponding Canadian Patent Application No. 3,060,107, dated Jun. 22, 2020.
International Preliminary Report on Patentability for PCT/CA2019/050314, dated Mar. 20, 2020.
Korean Patent Application No. 10-2020-7029412, Korean Office Action dated Dec. 21, 2020—English Translatio Available.
Australian Patent Application No. AU20190233857, Office Action dated Oct. 2, 2020.
International Patent Application No. PCT/CA2019/050314, Written Opinion dated Feb. 18, 2020.
European Patent Application No. 19768163.8, Extended European Search Report dated Apr. 23, 2021.
Japanese Patent Application No. 2020-547206, Office Action dated Mar. 30, 202—English Translation not available.
Written Opinion dated Mar. 30, 2021, issued on Singaporean patent application No. 11202008631V.

* cited by examiner

COMPOSITE STRUCTURE WITH SEPARATOR FOR COINS AND THE LIKE

CROSS REFERENCE TO RELATED APPLICATIONS

This application is the U.S. national stage application of International Application PCT/CA2019/050314, filed Mar. 14, 2019, which international application was published on Sep. 19, 2019, as International Publication WO 2019/173921 in the English language. The International Application claims the benefit of priority to U.S. Patent Application Ser. No. 62/644,029, filed on Mar. 16, 2018, the contents of which are hereby incorporated by reference in entirety.

FIELD

The present disclosure relates generally to composite structures, for instance coins.

BACKGROUND

Conventional single, bi- and tri-metallic coins are commonly found in circulation worldwide. Bi-metallic coins often comprise two components made from two different materials. These two components are often different colours to each other for easy visual identification in instances where other coins similar in size and mass exist for different face values. For example, a bi-metallic coin may consist of an outer ring of white nickel finish and inner core of golden yellow bronze finish or vice versa. Because of its bi-colour feature and complexity to produce as compared to simple single piece coins, bi-metallic coins are normally used as higher denominations coins for security purposes. Other examples of such structures exist as coin blanks, tokens, medals, etc.

Multi-metallic coins provide some overt and covert security features. For instance, the visual difference and consequent electromagnetic signature as compared to single alloy coins offers a means for the coins to be recognized and validated based on parameter values set in coin readers such as those found in vending machines, self-checkout kiosks, parking meters, payphones and others.

Tri-metallic coins have recently been produced by countries such as France, South Korea and Mexico. These tri-metal coins are mostly comprised of one core and two rings.

The tri-metallic coins can be of different structures. These tri-metallic coins, like the bi-metallic coins, comprise an inner core and an outer ring. However, the inner core of the tri-metallic coins is comprised of two discrete inserts stacked on top of each other. Therefore, the tri-metallic coins not only comprise a juncture between the inner core and outer ring, but also between the inserts comprising the inner stack.

US 2014/0295204, for example, relates to a composite structure (e.g. a metal coin) having at least three different components. In one embodiment, the structure comprises an outer ring and two inserts stacked on top of each other and disposed within the outer ring. The outer ring and each of the two inserts are made of different materials. The outer ring and each of the inserts are locked together by a plurality of recesses formed in outer circumferential surfaces of the inserts. The structure may further comprise at least one interlayer disposed between the two inserts for adhering the two inserts to one another. The three major components and the interlayer may be made into a single structure by a striking force during coining or striking.

US 2015/0201721 describes a coin including a core made of a first metal, an outer ring surrounding the core concentrically and made of a further metal, and a central ring between the core and outer ring fixedly connected thereto. The central ring consists of an electrically insulating material. Further, the central ring is transparent to electromagnetic waves of a first wavelength range and is less transparent or not transparent to a second wavelength range.

US 2004/0173434 describes a coin having an outer ring and two inserts stacked on top of each other and disposed within the outer ring.

CA 2,092,941 describes a two-part blank for coins, medals, tokens, gambling chips and the like, including an inner disc of a first metal or a metal alloy, which is pressed into the central opening of an outer ring of a second metal or a second metal alloy, the outer edge of the disc being formed with obliquely extending depressions.

US 2014/0144751 describes a coin blank including an inner portion and at least one outer portion surrounding the inner portion. A dielectric isolation layer is arranged between the inner portion and the outer portion and connects the inner portion and the outer portion in a force-locking manner. The isolation layer is transparent in a first wavelength range and may be based on a transparent polymer. The isolation layer may contain additives absorbing and/or reflecting light in a second wavelength range.

The prior art describes several means by which the inner core and outer ring can be locked together. In U.S. Pat. No. 5,094,922 for example, a series of grooves parallel to the surface of the coin components are made on the outer ring and ridges are made on the inner core and the two components are joined by force using a regular coining press.

In U.S. Pat. Nos. 4,472,891 and 5,630,288, a groove or a series of discontinued grooves are made on the periphery of the inner core to allow material from the outer ring to flow to partially fill the grooves upon joining by force during striking of the coins.

In U.S. Pat. No. 6,189,197, ridges are produced on the periphery of the inner core, so that the excessive material on the ridges are forced to flow into the inner circumferential surface of the outer ring in order to join the two pieces together.

In U.S. Pat. No. 6,044,541, no special grooves or ridges are required; however, different thickness and hardness of the outer ring and inner core are necessary so that a lip or tongue is formed to cover the thinner component resulting in a locking of the two components.

SUMMARY

It is an object of the present disclosure to obviate or mitigate at least one disadvantage of previous approaches or to provide an alternative composite structure.

According to one aspect, there is provided a composite structure comprising an inner stack comprising a plurality of inserts stacked on top of each other; an outer ring annularly surrounding the inner stack; and a separator disposed between the outer ring and the inner stack separating the outer ring from the inner stack and separating the plurality of inserts from each other.

According to one aspect, there is provided differing frequency-dependent capacitance values between at least one of the following portions of the composite structure: (i) between the two stacked inserts (3,4), (ii) between the first insert (3) and the outer ring (1), or (iii) between the second insert (4) and the outer ring (1). The differing values may generate up to three different frequency-dependent values providing a capacitance signature for authentication.

According to one aspect, there is provided an authentication method comprising measurement of capacitance of the separator (2) across the first insert (3) and the second insert (4), about the first insert (3) and the outer ring (1), and about the second insert (4) and the outer ring (1).

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1A:
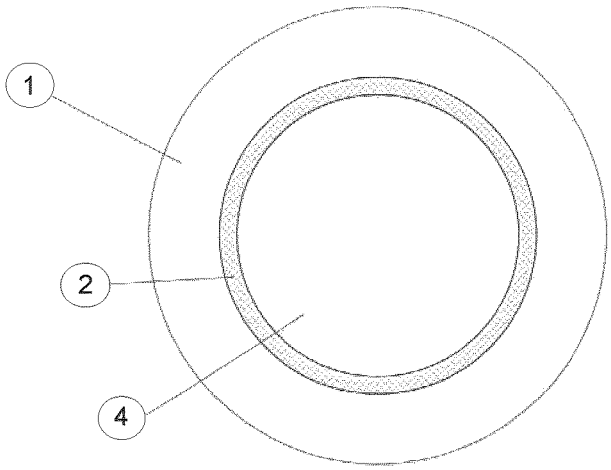
FIG. 1 (A, B, C, D) is a top view, bottom view section view, and detailed section view respectively, of a coin, together with an outer ring, two inserts, and a separator.
Figure 1B:
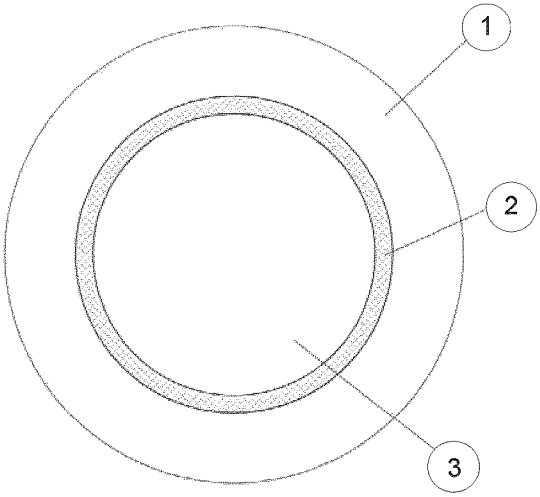

According to one aspect, there is provided a composite structure comprising an inner stack comprising a plurality of inserts stacked on top of each other; an outer ring annularly surrounding the inner stack; and a separator disposed between the outer ring and the inner stack separating the outer ring from the inner stack and separating the plurality of inserts from each other.

The structure may be any suitable composite structure and, by way of example only, may be a coin, coin blank, token, chip, gaming chip, medallion, or medal.

The structure may comprise an outer ring and two or more inserts stacked on top of each other (collectively, an "inner stack") and annularly surrounded by an outer ring. The structure may further comprise a "separator" disposed between the outer ring and the inner stack separating the outer ring from the inner stack and separating the inserts of the inner stack from each other.

The separator may comprise a wall shaped to annularly surround the inner stack and fit between the inner stack and the outer ring. The separator may also have at least one divider positioned to separate the inserts from each other.

The outer ring, the two inserts, and the separator may be made of different materials. The outer ring may be locked to the separator by a plurality of recesses formed in the outer surface of the wall of the separator. The separator and each of the two or more inserts may be locked together by a plurality of recesses formed in the outer circumferential surface of each of the two or more inserts. The multiple major components, namely, the inserts, the outer ring and the separator, may be joined by a striking force, for example before coining or during coining. Other methods of joining may include overmolding, bonding, and ultrasonic welding.

The outer ring, the inserts, and the separator may be made of different materials and may be of different colors.

The separator may have one or more protrusions, each extending to the opposing outer surfaces of the inner stack.

Each insert and the outer ring may be made of different materials and the inner surface of one insert may be marked with a security mark viewable on its face or through a protrusion.

A force locking mechanism may be provided to retain the configuration of the coin, coin blank, token, chip, gaming chip, medallion, or medal.

The composite structure may have an electrical junction resistance (JR) which is maintained within an acceptable range that can be recognized by coin readers. This may be accomplished by the separator by mitigating corrosion at junction points.

The composite structure may provide overt, covert, or forensic security and reliable identification.

The figures show a coin comprising an outer ring (1), a separator (2), a first insert (3), and a second insert (4) (collectively, the "inner stack" (3,4)).

The inner stack (3,4) may be of any suitable shape, for instance circular, elliptical, regular or irregular polygonal or shaped cross section and the separator and outer ring may be shaped accordingly.

With reference to FIG. 1, the structure may comprise an outer ring (1), a first insert (3), a second insert (4), and a separator component (2). The separator (2) is disposed between the ring (1), the first insert (3), and the second insert (4). The separator (2) consisting of at least one wall (2A) and at least one divider (2B) as shown in FIG. 1D. This configuration serves to separate the ring (1), the first insert (3), and the second insert (4) from each other.

With reference to FIG. 1, a very specific but non-limiting example is provided including specific dimensions for illustration. A metallic ring (1) may be made from multi-ply plated steel that has a coating of electrodeposited brass. The metallic ring (1) may have a gauge thickness of at least 2.0 mm. The metallic ring (1) may have a gauge thickness of less than or equal to 3.5 mm. The ring may be round or multi-sided (non-equal lengths) fitting within a circumscribed circle of 27.0 mm. The outside edge or edges of the ring may be smooth or may comprise edge lettering and interrupted serrations. The outer ring (1) may have an aperture with a diameter of 18.0 mm. The surface of the aperture may or may not contain one or more surface treatments to assist in locking the separator (2) to the outer ring (1) during assembly.

Figure 7:
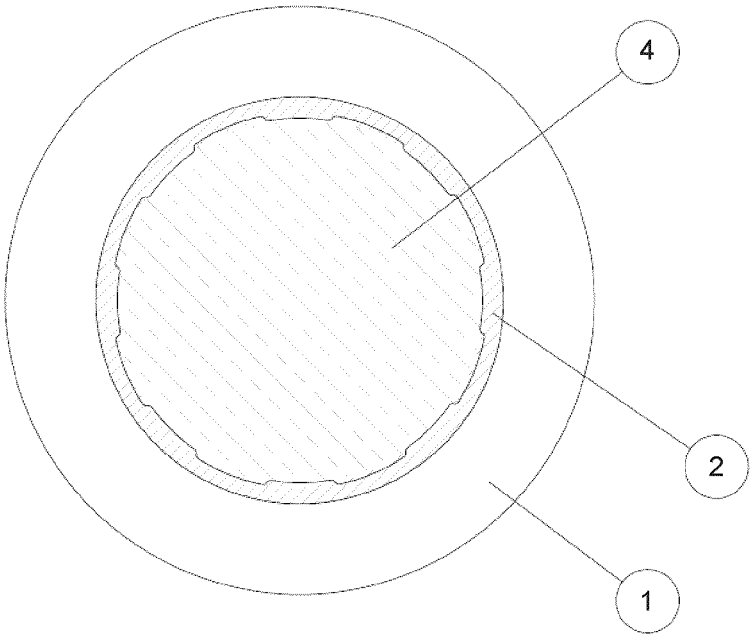
FIG. 7 is a top view of a coin according to a disclosed embodiment.

The inner stack (3,4) may have a diameter of 16.0 mm and gauge thickness of at least 0.5 mm. The inner stack (3,4) may have a gauge thickness of less than or equal to 3.5 mm. Each insert (3) and (4) may have a thickness of 0.92 mm. The first insert (3) may be made from a cupronickel substrate with multi-ply plated technology resulting in a white top color (i.e. nickel). The second insert (4) may be made from a different copper alloy substrate with a red bronze top layer achieving a pink color. The outer edge of each metallic insert may comprise a surface treatment to assist in locking the separator to the circumferential surface of the metallic insert. The surface treatment may include a continuous groove within a convex peripheral surface (FIG. 7).

The separator (2) may be made from a transparent material such as, but not limited to, polysulfone, co-polyester, or another transparent polymer, glass, or ceramic. The transparent material may have a low haze, high clarity, measurable light transmission, and a measurable refractive index. The separator (2) incorporates a red dye and an embedding material that alters the electromagnetic signal (EMS) of the separator (2). Particles, for instance quantum dots, may be selected as the embedding material with a pre-determined volume fraction that imparts an EMS variation and/or time gated response within the visible spectrum under certain excitation conditions.

A further embodiment comprises a biconvex transparent separator (2). When an appropriate light source is utilized for authentication, the separator (2) may act as a lens to magnify objects observed from one side of the separator (2) to another. For example, the separator (2) may be transparent with a haze value less than 5% according to ASTM D1003. The refractive index of the separator (2) may be 1.625-1.650, and the yellowness index of the separator (2) may be less than 15 according to ASTM D1925. The separator (2) may incorporate a transparent red dye that results in light transmission in the visible wavelength range of 40% according to ASTM D1003. When the radius of curvature of the biconvex separator (2) is 2.5 mm and the thickness of the separator is 2.5 mm, and an object is placed 2.8 mm from the separator, and the object is viewed through the separator under appropriate lighting conditions, then the magnification of the object will appear approximately 6 times greater than the actual size of the object. Such a feature may be utilized to authenticate the composite structure as genuine. Additionally, the sole purpose of the separator when acting as a lens may be to intensify the light source at a specific focal length on the opposing side of the separator. Such intensification may also be utilized to authenticate the composite structure as genuine.

The separator (2) may be made from an electrically conductive composite material such as, but not limited to, long aspect ratio type 304 austenitic micro-stainless steel fibers filled within a polysulfone matrix. The electrically conductive composite material acts to provide electrical continuity between the metallic outer ring (1) and each inner insert (3) and (4), as well as providing electrical continuity between the stacked insert (3) and insert (4).

In addition to the electrical continuity enhancement of the fiber filled composite material, the fibers reinforce the mechanical strength over the base resin and provide improved tribological properties.

Depending on the processing method, fillers may change the magnetic permeability of the composite material due to cold working of the fibers that transforms the austenitic phases of the stainless steel to either martensitic or ferritic phases. Both the electrical conductivity and magnetic permeability of the separator may be tailored depending on processing conditions, fiber aspect ratio selection, and fiber volume fraction, along with the geometry of the separator (2) to produce a unique EMS signature of the overall composite coin structure that is difficult to replicate. Thus, security of the composite coin structure may be enhanced. In addition to the mechanical and electrical property changes, adding a long aspect ratio micro-fiber to the polysulfone matrix may act as an overt security thread.

Figure 2:
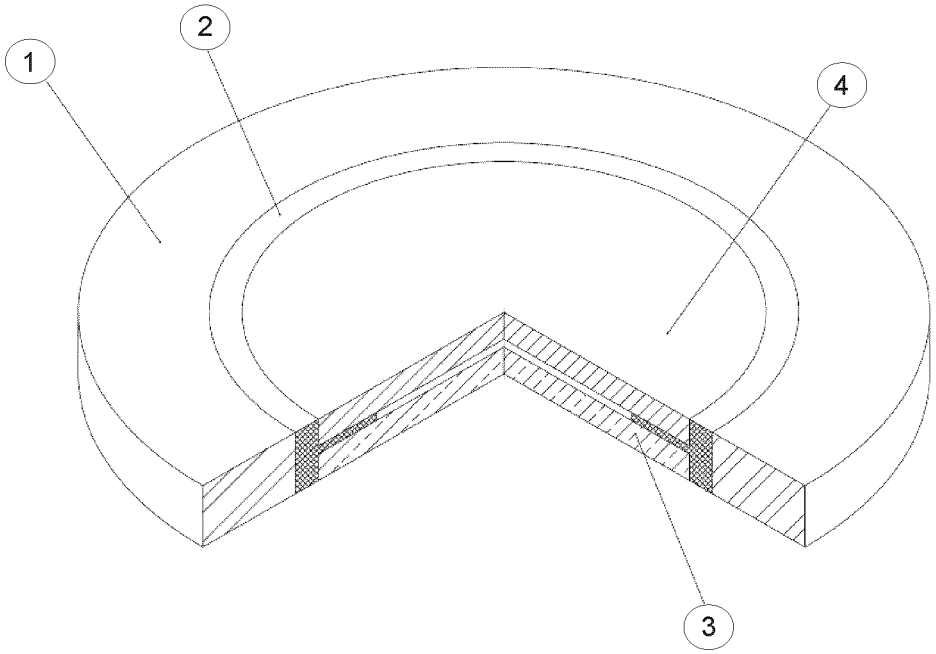
FIG. 2 is a schematic cross-sectional view of a coin according to a disclosed embodiment.

With reference to FIG. 2, the divider of the separator (2) may comprise an aperture that separates the first insert (3) from the second insert (4). The inner inserts (3,4) may be separated from each other with a defined void between each insert depending on the geometry of the separator (2), while each inner insert (3,4) may be separated from the outer ring (1) through contact with the separator (2).

Depending on the selection of inserts (3,4), and divider thickness of the separator (2), the void acts to generate an identifiable EMS signature due to the void. A person skilled in the art would select a separator (2) material so as to generate adequate electrical continuity or magnetic permeability contrast between the void and the separator (2) material such that where there is a void between inserts, a unique composite EMS signature is generated between the two areas when the coin is validated. One skilled in the art may also select any suitable size of aperture in the divider of the separator (2) so as to provide separation of the stacked inserts (3,4) as well as providing a certain displacement of the divider material in order to produce contrasting electrical and magnetic properties through the thickness of the composite coin structure. This, in turn, will produce a different EMS signature spatially across the centerline of the composite structure thus increasing security.

Figure 3:
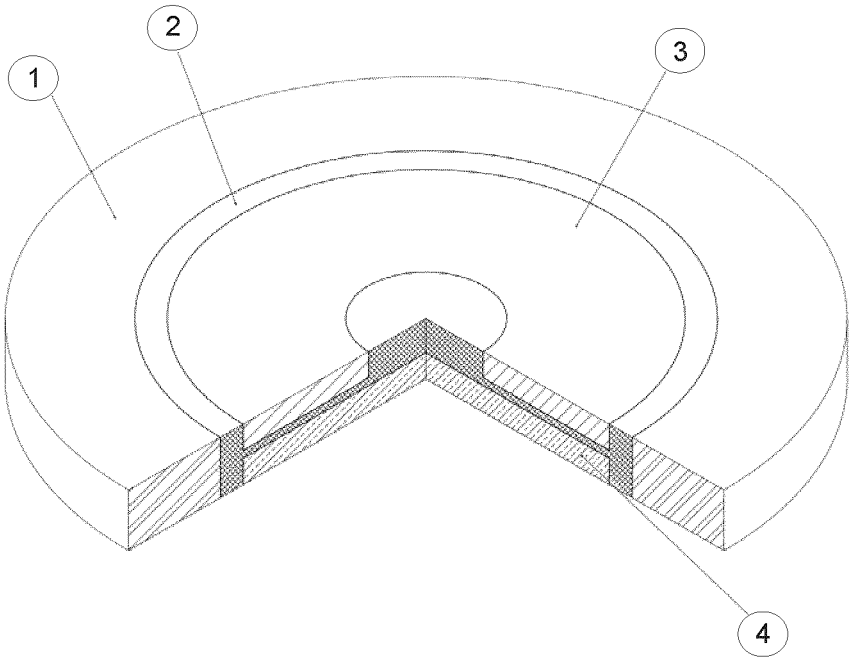
FIG. 3 is a schematic cross-sectional view of a coin according to a disclosed embodiment.
Figure 4:
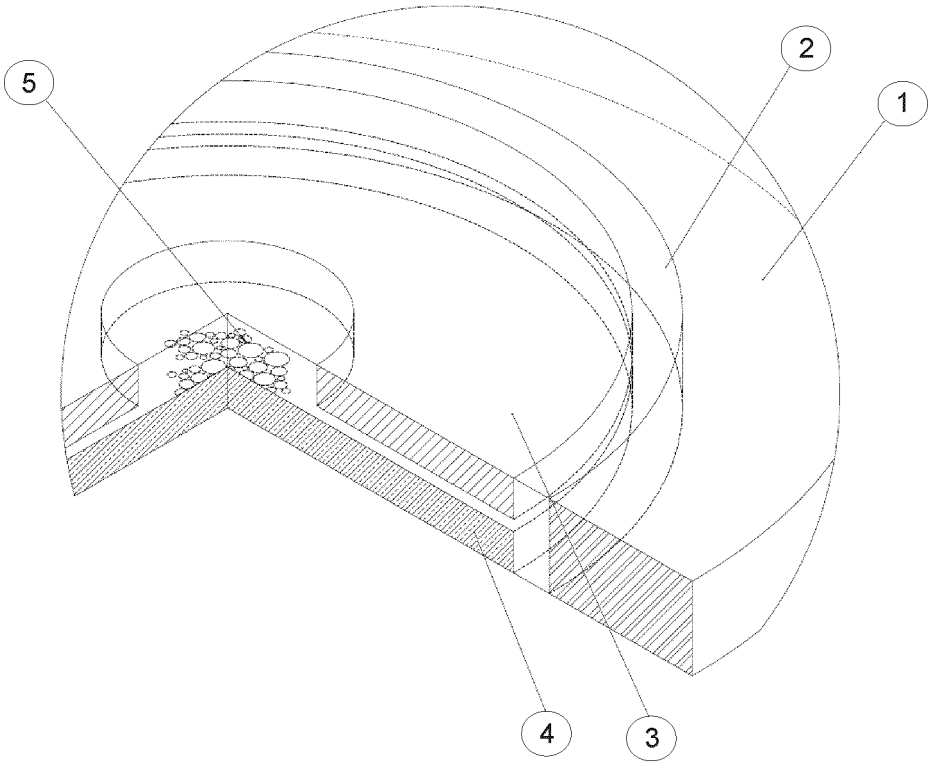
FIG. 4 is a schematic cross-sectional view of a coin according to a disclosed embodiment.

With reference to FIGS. 3 and 4, the separator (2) may have a protruding circular column which extends to the surface of the first insert (3). This column may be of any suitable height and shape.

The separator (2) may be made from a transparent material such as, but not limited to, polysulfone, co-polyester, or another transparent polymer, glass, or ceramic containing a dye or pigment to impart a specific color.

Further, the transparent material may function to protect the underlying surface of the second insert (4) and may function as an optical window to the lower insert's (4) inner surface.

Further, the separator (2) may function as an optical waveguide. An appropriate light source may be placed on or near the protruding circular column and may transmit light to the wall of the separator (2A) through the divider of the separator (2B) thus illuminating the wall of the separator from a distance.

Further, the separator (2) may function as an optical waveguide in that an appropriate ringed light source placed on or near the wall of the separator (2A) will transmit light to the protruding circular column of the separator through the divider (2B) of the separator thus illuminating the protruding column from a distance.

Such optical waveguide functionality may provide overt security means for the composite coin structure.

A marking such as, but not limited to, a decorative mark or security mark (5) may be located on the inner surface of the second insert (4) such that it can be viewed though the transparent protrusion.

A person skilled in the art may choose to place additional security features, material(s), or coating(s) on the inner surface of the second insert (4). Thus, the separator may protect the security feature from wear and damage during circulation.

Alternatively, the security feature (5) may be incorporated into the separator (2) at the base of the protrusion. Depending on the design method selected, the components may require an orientation system and a vision system to aid in proper assembly.

Additionally, if the separator (2) material has low electrical conductivity and low magnetic permeability, the protrusion may act to change the electromagnetic signature of the coin within the diameter area (6 mm in the example above) due to the lack of metallic material in this volume.

A person skilled in the art may select a composite material for the separator (2) so as to tailor the tribological properties to improve its wear performance, and/or to design a unique electrical conductivity and magnetic permeability composite material to generate a unique EMS signature within the limitations of the protrusion.

Figure 5:
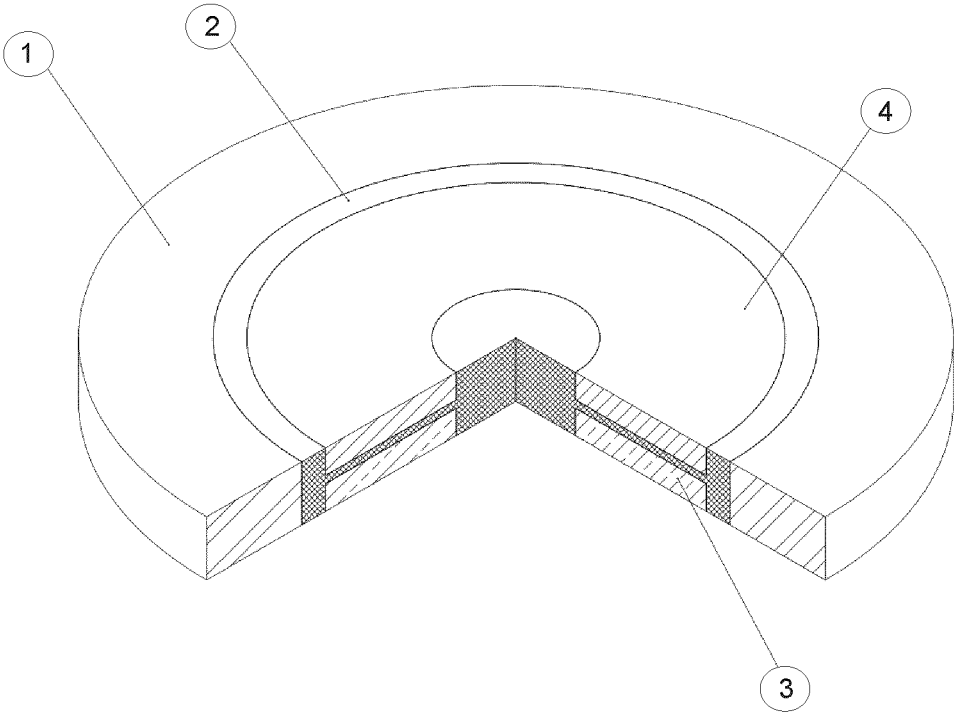
FIG. 5 is a schematic cross-sectional view of a coin according to a disclosed embodiment.

With reference to FIG. 5, the separator may comprise two protruding circular columns originating from the divider and terminating at the outer surfaces of the inner stack. The height and shape of each column may be selected from any desired size and shape.

The separator may be made from a transparent material such as, but not limited to, polysulfone, co-polyester, or another transparent polymer, glass, or ceramic containing a dye or pigment to impart a specific color.

Figure 6A:
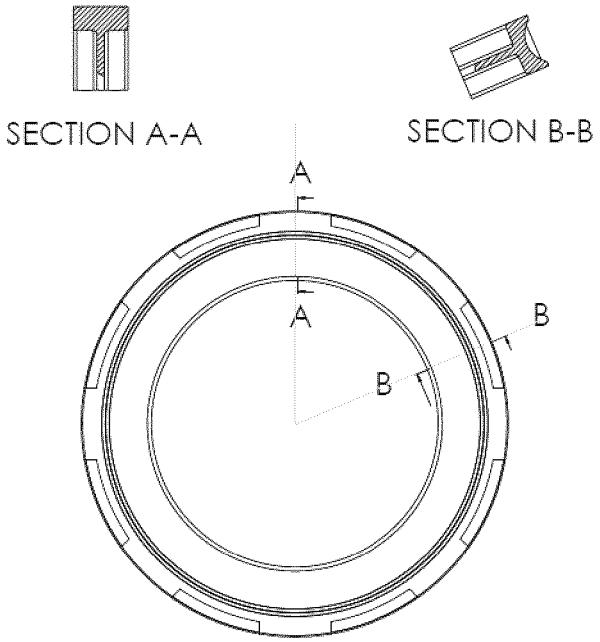
FIG. 6A is a top view of a disclosed embodiment of a separator.
Figure 6B:
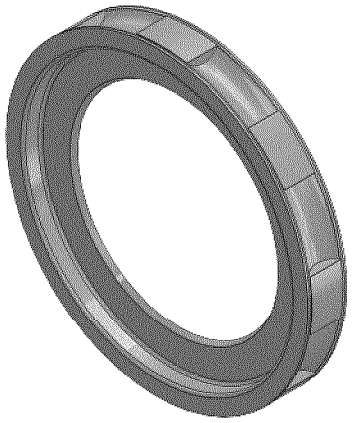
FIG. 6B is a perspective view of a disclosed embodiment of a separator.

The separator (2) may comprise a variation in cross-sectional area with varying thickness at the circumference. An example of such a variation is shown in FIG. 6. In one embodiment, the cross-sectional thickness of the separator may be 1.0 mm at 0, 45, 90, 135, 180, 225, 270, and 315 degrees from the 12 o'clock position (See section A-A in FIG. 6). In the same embodiment, the cross sectional thickness is reduced to a depth of 0.5 mm at equidistant intervals between the 1.0 mm cross-sectional regions around the periphery of the separator (see section B-B in FIG. 6). The inner diameter of the separator that houses the inserts is constant. Upon forming the composite coin structure, regions that contain high cross-sectional thickness may have increased resistance to deformation due to the increased cross-sectional area and resulting stiffness in this region compared to the low cross-sectional area regions of the separator.

As a result of this difference in cross sectional area, the stacked insert (3 or 4) may deform to a greater extent in the radially outward direction in regions of less cross-sectional thickness compared to the thick cross sectional area regions. The result of which generates a shaped outer diameter of the inner insert that was circular prior to forming, and also generates a shaped inner diameter of the separator (2) that was circular before forming (FIG. 7). The benefit of the separator in this embodiment over certain prior art is the ability of the separator to generate a "shaped" inner insert due to the coining operation.

In addition to the regular cross-sectional area variation around the circumference of the separator (2), the separator (2) outer diameter (OD) and inner diameter (ID) may or may not be constant resulting in a circular separator (2). For example, in addition to the periodic cross-sectional areas around the circumference of the separator (2), the OD and ID of the separator may also vary in thickness whereby the thin cross sectional area regions of the separator have larger OD/ID dimensions compared to the thick cross sectional regions. Such variation in OD/ID further facilitate the shaping of both the inserts (3, 4) and the outer ring (1) into an undulating shaped final geometry after coining due to the radial nature of the deformation process facilitated by the curvature of the forming dies. Advantageously, such final geometry is generated from typical annular rings and inserts with circular preform geometry and hence requiring no special processing or orientation dependence prior to striking.

Certain prior art requires the blanking of the inner inserts into the shape with non-uniform cross-sectional area prior to coining, and further requiring the outer ring to be pierced into an analogous shape, and further requiring the two components to be oriented prior to striking.

A typical circular hole may be required in the outer ring, and a typical circular outer diameter may be required in the insert with no requirement for orienting the pieces together prior to the coining operation.

One skilled in the art may select different quantity and contrast in cross-sectional thickness within the separator as well as contrast in material properties of each of the composite coin components so as to generate varying degrees of non-uniformity in cross-sectional area of the shaped inserts, shaped separators, and shaped outer rings upon coining the composite coin structure.

When viewed under transmitted light, the composite coin may exhibit light transmission through the protruding circular column of the separator (2), as well as around the perimeter of the separator (2).

A person skilled in the art may add additional micro or nano security features, such as, embedding micro or nano particles to the separator (2) so as to provide an additional overt, covert, or forensic means of authenticating the coin as genuine. Since each protrusion need not be the same size, shape, or have the same dimensions, a person skilled in the art may specifically alter the dimensions of each column independently so as to produce an optical window to a portion of the underlying inner surface of the opposing insert (see, for example, FIG. 8).

For clarity, by "metal" is meant metals, metal alloys, plated metals, plated metal alloys and composite metallic alloys.

By "annularly surround" is meant forming a ring around a component and includes circular, rectangular, and other regular and irregular polygonal or shaped rings. The component that is annularly surrounded may also be shaped to be circular, rectangular, or any other regular or irregular polygon and the aperture of the ring shaped to fit.

By "separator" is meant a component disposed between the outer ring and the inner stack separating the outer ring from the inner stack and separating the inserts from each other. The separator may comprise at least one wall disposed between the outer ring and the inner stack and at least one divider disposed between the one or more inserts.

Figure 8:
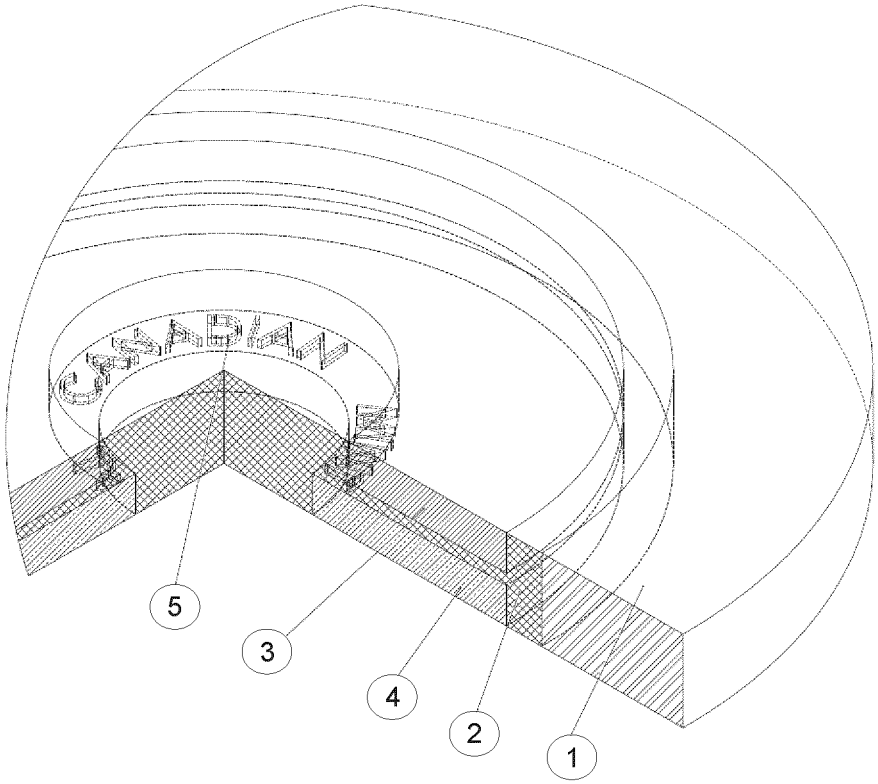
FIG. 8 detailed schematic cross-sectional view of a coin according to a disclosed embodiment.

The separator geometry may be designed with general geometrical features as shown in FIG. 8. For example, the separator may have two pockets to receive two inserts and a wall to separate the two inserts from the outer ring, in which the two pockets may or may not be of the same shape and dimensions, and two pockets may be divided partially or completed by a divider. The divider of the separator may or may not be connected to the wall of the separator.

The separator may be made of metallic, non-metallic, polymer, glass, ceramic, metallic composite, non-metallic composite, conductive, semi-conductive, dielectric, magnetic or non-magnetic, or mixture of the above, coated or plated of the above, by conventional material making or synthetization or by modern additive manufacturing process, 3D printing, etc. The separator may also be embedded with functional micro or nano particles.

The separator may function to hold, separate the two inserts and the outer ring, and also lock them. Additionally, the separator may function to provide electrical, magnetic, electromagnetic, optical and/or visual features.

By "separated" is meant the components are not in contact with each other.

By "dielectric material" is meant a material that has electrically insulating properties.

By "conductive material" is meant a material through which electric current can flow.

By "semi-conductive material" is meant a material with electrically conductive properties falling in the range between dielectric material and conductive material.

By "transparent" is meant a material with high clarity, low haze, a measurable refractive index, and a measurable degree of light transmission according to ASTM D1003 standard or another comparable standard.

By "translucent" is meant a material with intermediate to high haze, with intermediate to low clarity, and a measurable degree of light transmission according to ASTM D1003 standard or another comparable standard.

By "opaque" is meant a material with no light transmission according to ASTM D1003 standard or another comparable standard.

By "major axis" is meant the longest diameter of a non-circular shape separating the widest points of the perimeter.

By "minor axis" is meant a diameter of a non-circular shape that is not the major axis.

Materials

The electromagnetic properties of a composite coin structure is dependent on the composition of its constituent parts. Table 1 lists examples of matrix materials that can be used to constitute each of the four components of the composite coin structure. The outer ring (1), first insert (3) and second insert (4) and separator (2) may be made from any suitable material, for instance from the matrix materials listed in Table 1 including both metallic and non-metallic combinations for the structures depicted in FIGS. 1 through 11.

Metallic components may have surfaces coated with a dielectric material such that varying the dielectric constant and thickness of the coating or coatings facilitates tailoring the composite dielectric properties between the metallic components. A unique and measurable composite capacitance value between the metallic components may thus be generated in order to authenticate the structure as genuine.

Examples of potential filler materials for mechanical, EMS, and optical optimization purposes are listed in Table 2.

The size, volume fraction, and distribution of the filler materials may be adjusted within the matrix material to optimize mechanical, EMS, and optical performance of the matrix material.

Materials may further be transparent, translucent, opaque and/or coloured. For example, the composite structure may comprise a transparent separator or a transparent or translucent coloured separator, such as red.

TABLE 1

Example materials list by type for outer ring (1), first insert (3) second insert (4) and separator (2) materials.

| Metallic Materials |
|---|
| Plated or Multi-ply plated steel or alloy substrate |
| Copper and copper alloys |
| Iron and iron alloys including steel |
| Aluminum and aluminum alloys |
| Zinc and zinc alloys |
| Titanium and titanium alloys |
| Nickel and nickel alloys |
| Brass plating on steel or alloy substrate |
| Bronze plating on steel or alloy substrate |
| Gold and gold alloys |
| Silver and silver alloys |
| Platinum and platinum alloys |
| Ni plating on steel or alloy substrate |
| Cu plating on steel or alloy substrate |
| Gold, silver and or other precious metal plated metallic or non-metallic substrate |
| Non-Metallic Materials |
| Polyvinylidene fluoride (PVDF) |
| Ethylene tetrafluoroethylene (ETFE) |
| Ethylene chlorotrifluoroethylene (ECTFE) |
| Liquid Crystal Polymer (LCP) |
| Polyetheretherketone (PEEK) |
| Polymethyl methacrylate (PMMA) |
| Copolyester |
| Polyphenylsulfone (PPSU) |
| Polyamide-imide (PAI) |
| Polysulfone (PSU) |
| Polyethersulfone (PESU) |
| $Al_2O_3$ |
| MgO (nanophase) |
| $TiO_2$ (nanophase) |
| $NaAgMoO_4$ |
| ZnO—$TiO_2$ (nanophase) |

TABLE 2

Example filler materials for mechanical and/or EMS optimization purposes.

| Embedding Material |
|---|
| $SiO_2$ |
| Carbon Fiber |
| Glass Fiber |
| Mineral Fiber |
| Quantum Dots |
| Kevlar |
| OVI's |
| Taggants |
| Fluorescent nanodiamonds |
| $Mn_xZn_{1-x}$—$Fe_2O_4$ (x = 0.35-0.65) |
| Co-based Amorphous Alloys - Metglas 2714A |
| $Fe_3O_4$ nanoparticles |
| Gamma-$Fe_2O_3$ nanoparticles |
| Nanocrystalline Fe—M—B Ternary Alloys (M = Zr, Hf, Nb, Si) |
| Nanocrystalline Fe—Si—B—Nb—Cu Alloys |
| Nanocrystalline Supermalloy Powder |
| Ni, Fe, Mo, Cu, Ag, nanocrystalline Al2O3 |
| $SnO_2$ + M (M = Cr, Mn, Fe) |
| Nanocrystalline $Al_2O_3$ |
| Stainless Steel Fiber |

Table 3 lists examples of possible combinations of materials.

TABLE 3

| Possible Embodiment Examples | | | | | |
|---|---|---|---|---|---|
| | | Specs | | | |
| | | Embodiment X | Embodiment Y | Embodiment Z | Embodiment M |
| | | FIG. | | | |
| | | 1 | 2 | 3, 4 | 3, 4 |
| Ring (1) | Material | MPPS Bronze plated | MPPS Bronze plated | MPPS Edge lettering serrations | Brass plated |
| | Shape | multi-sided | multi-sided | round | round |
| | OD (mm) | 27. | 30.0 | 22.0 | 25.0 |
| | ID (mm) | 18.0 | 17.0 | 14.0 | 15.5 |
| | Thickness (mm) | 2.3 | 2.50 | 2.00 | 2.00 |
| | Locking Feature | Single ID intermittent groove | Dual ID intermittent groove | Dual ID intermittent groove | Single ID intermittent groove |
| First Insert (3) | Material | Cupro Nickel | Cupro Nickel | Cupro Nickel | Cupro Nickel |
| | Shape | Circular | Circular | Circular | Circular |
| | OD (mm) | 16.0 | 15.0 | 14.0 | 14.2 |
| | Aperture Size (mm) | — | — | 6.0 dia | — |
| | Thickness (mm) | 1.13 | 1.25 | 1.0 | 1.0 |
| | Locking Feature | Single OD continuous groove Non-planar (convex) | Single OD continuous groove Non-planar (convex) | Single OD continuous groove Non-planar (convex) | Single OD continuous groove Non-planar (convex) |
| Second Insert (4) | Material | 1006 steel + red bronze plating | 1006 steel + red bronze plating | 1006 steel + red bronze plating | 1006 steel + red bronze plating |
| | Shape | Circular | Circular | Circular | Circular |
| | OD (mm) | 14.0 | 15.0 | 14.0 | 14.2 |
| | Thickness (mm) | 1.13 | 1.25 | 1.00 | 1.00 |
| | Locking Feature | Single OD continuous groove Non-planar (convex) | Single OD continuous groove Non-planar (convex) | Single OD continuous groove Non-planar (convex) | Single OD continuous groove Non-planar (convex) |
| | Security Mark Side | — | — | Inner | — |
| | Security Mark Feature | — | — | Microtext within the separator protrusion window | — |
| Separator (2) | Matrix Material | Copolyester (Red) | PEEK (blue) | Polysulfone (Translucent Red) | Nickel brass alloy |
| | Shape | Separator | Separator with aperture | Separator with single sided protrusion | Separator |
| | OD (mm) | 18.0 | 17.0 | 14.0 | 15.5 |
| | ID (mm) | 16.0 obverse side, 14.0 reverse side | 15.0 | 13.0 | 14.2 |
| | Width (mm) | 1.0 obverse, 2.0 reverse | 1.0 | 0.5 | 0.65 |
| | Aperture Size (mm) | — | 10.0 dia. | — | — |
| | Protrusion Side | — | — | Obverse | |
| | Protrusion Size (mm) | — | — | 6.0 dia centrally located | — |
| | Locking Feature | Single OD groove | Multiple OD groove | Concave serrated surface | Concave serrated surface |
| | Embedding Particle | Glass Fiber | — | Quantum Dots | micro-particles |
| | Volf. (%) | 15 | — | 5.0 | 2.0 |
| | Size (microns) | 9 OD × 50 | — | 0.005 | 1-3 |

Locking Features

Various locking options are indicated in Table 4 and in FIGS. 12 to 16. Locking features may be combined and may be applied to any component-component interface within the composite structure.

For example, a continuous groove, a rough surface finish, and a contoured surface may be formed on outer wall surface of the separator (2) to provide both additional mechanical locking and adhesion between the separator and the outer ring. By applying a continuous groove to the outer perimeter of the separator prior to coining, a void is created, into which the plastic from the outer ring can flow during coining thereby enhancing mechanical locking.

A suitable surface roughness may provide both greater surface area and a higher surface energy resulting in enhanced adhesion at the interface. Any suitable combination of locking features found in Table 4 may be combined at any component-component interface in the candidate composite structures to achieve appropriate locking force.

TABLE 4

Examples of potential locking features

| Locking Feature | Description | Reference |
|---|---|---|
| Internal Knurling | Formed or cut cross-hatch pattern, straight or angled serrations, etc. on inside bore | Common metal cutting/forming operation |
| External Knurling | Formed or cut cross-hatch pattern, straight or angled serrations, etc. on external bore | Common metal cutting/forming operation |
| External Rimming | External Surface Profile | Common in Coining |
| External Rimming with Groove | External Surface Profile | Common in Coining |
| External Edge Lettering | Formed text or shapes such as angled serrations or chevrons, etc. on external bore | Common in Coining |
| High Surface Roughness (internal or external) | Abrasive Methods (grinding, barrel finishing) | Common metal cutting/forming operation |
| High Surface Roughness (internal or external) | Cutting Methods (sawing, water jet, laser) | Common metal cutting/forming operation |
| High Surface Roughness (internal or external) | Chemical Conversion or Etching | Common surface treatment |
| High Surface Roughness (internal or external) | Thermal Methods (oxidation) | Common metal heat treatment |
| Internal Tube Expander | Expanding Tube ID and OD | Common tube forming operation |

Many non-metallic materials such as polymers are viscoelastic in nature and generally experience some elastic recovery during plastic deformation. Additionally, many polymers experience strain softening during plastic deformation thus reducing their yield point when further mechanically loaded after being plastically deformed. Significant time dependent elastic recovery of polymers may occur when internal stresses have been applied such as through a coining operation. By contrast, metals experience minimal elastic recovery once plastically deformed, and little time dependent strain recovery unless subjected to significant stress at temperatures greater than 0.5*Tm where Tm is the melting point of the metal.

Therefore, by plastically flowing metal into the vacated groove of a non-metallic material and minimizing the plastic deformation of the non-metallic material, a more time dependent stable geometry is expected with greater contacting surfaces, thus providing greater resistance to detachment by an external force.

Figure 9A:
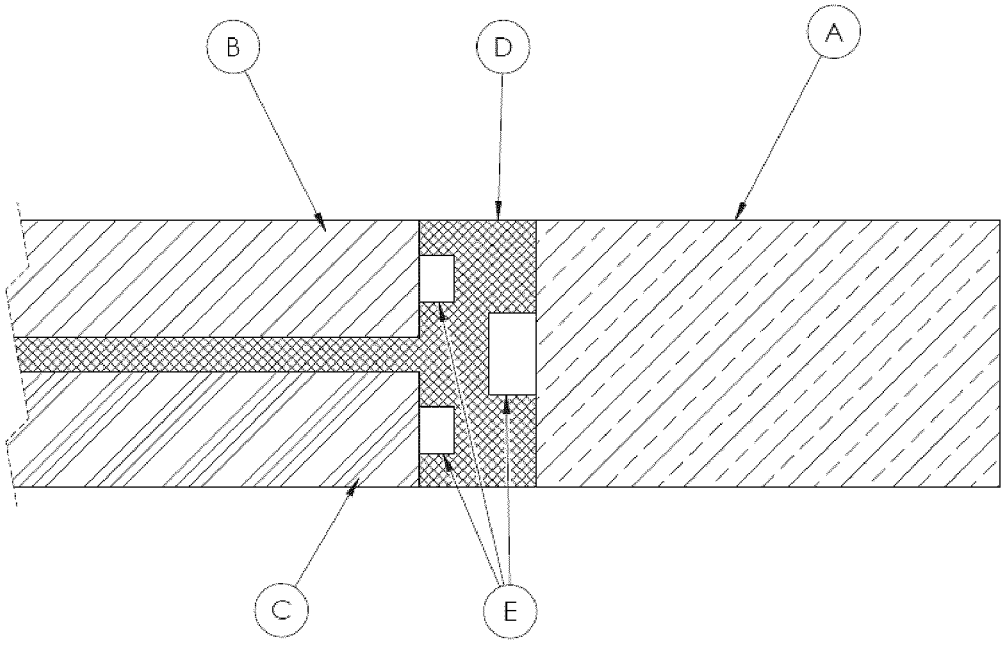
FIG. 9 (A, B) is a schematic cross-sectional view of vacated grooves (E) in the separator materials (D) prior to assembly and after assembly, respectively, showing the flow of the ring (A) and insert materials (B, C) into the vacated grooves (E) in the separator materials (D).
Figure 9B:
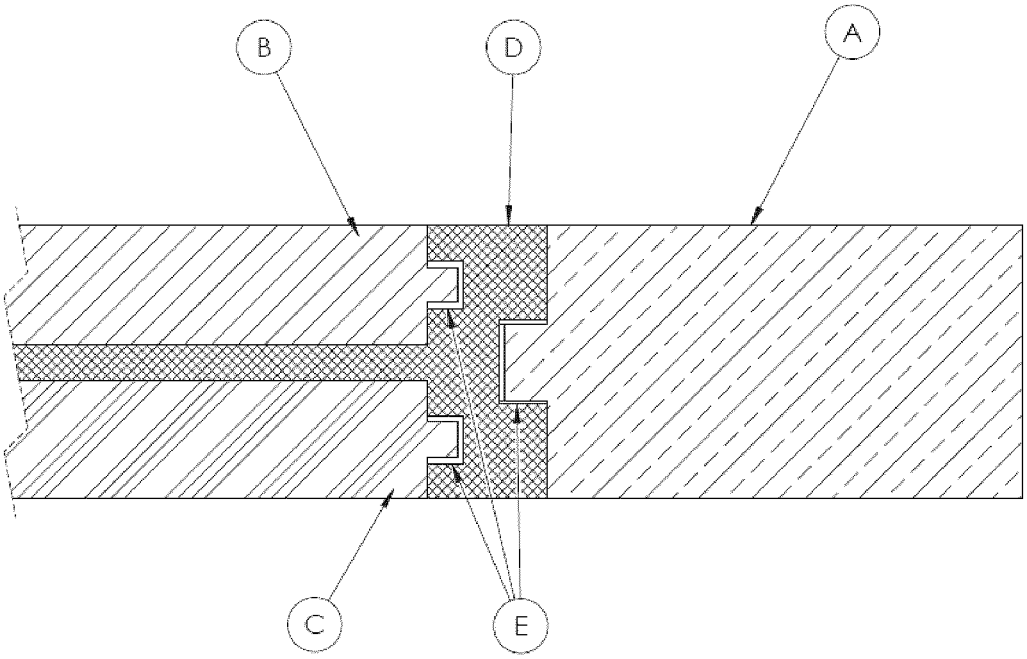

For example, FIG. 9A indicates non-metallic separator material containing vacated grooves. The ring (A), and inserts (B,C) plastically flow into the vacated grooves (E) in the separator material (D during pre-assembly or coining (FIG. 9B).

Figure 10:
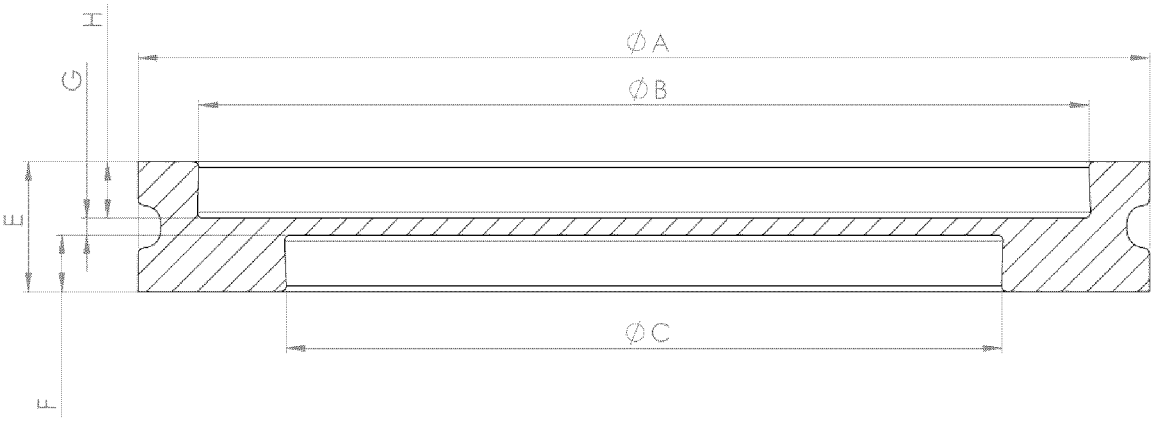
FIG. 10 is a schematic cross-sectional view of a polymer separator geometry with undercut and external edge groove.
Figure 11:
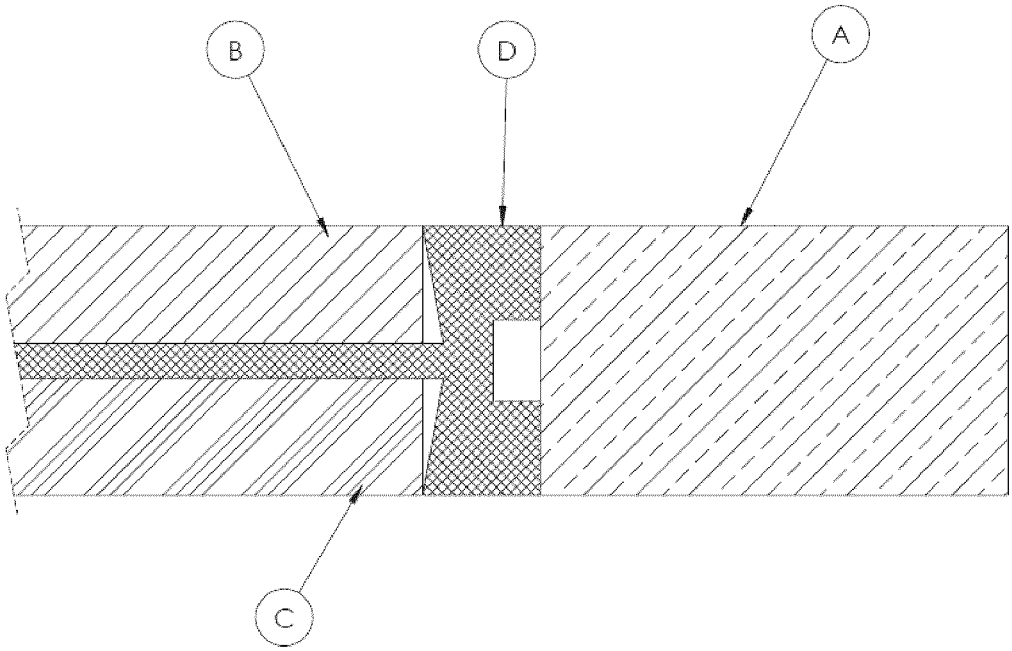
FIG. 11 is a schematic cross-sectional view of geometric details for an embodiment after pre-assembly.
Figure 12:
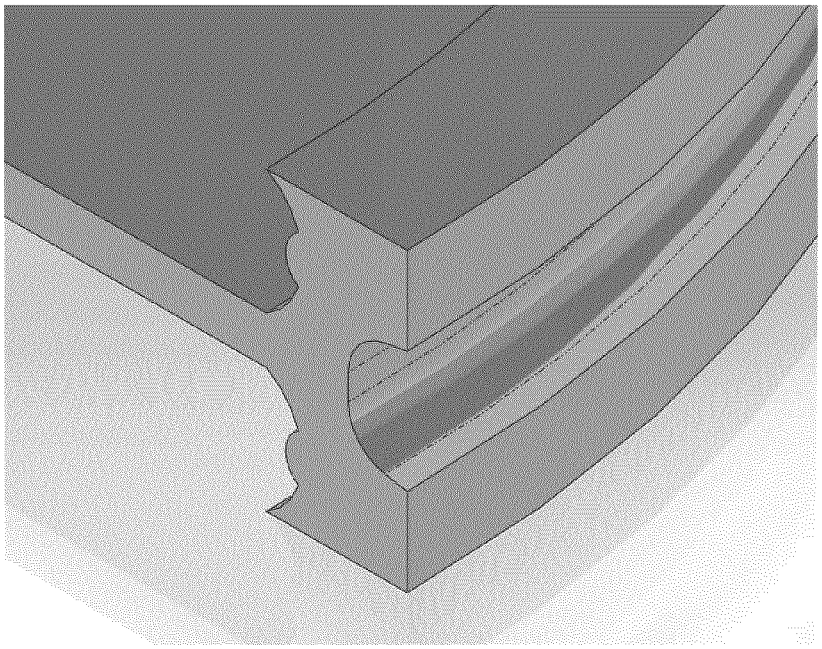
FIG. 12 is a perspective view of a separator with a single peripheral groove on the outer wall.
Figure 13:
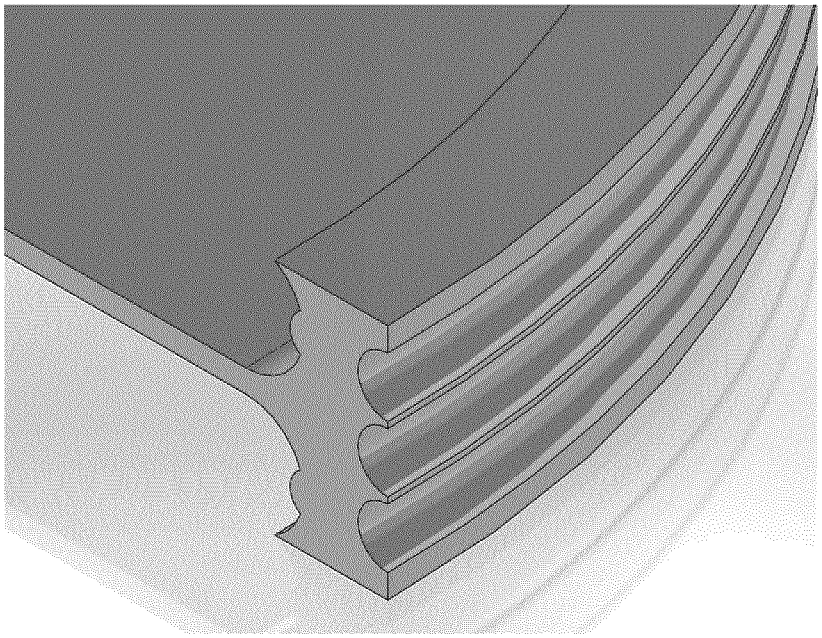
FIG. 13 is a perspective view of a separator with a plurality of peripheral grooves on the outer wall.
Figure 14:
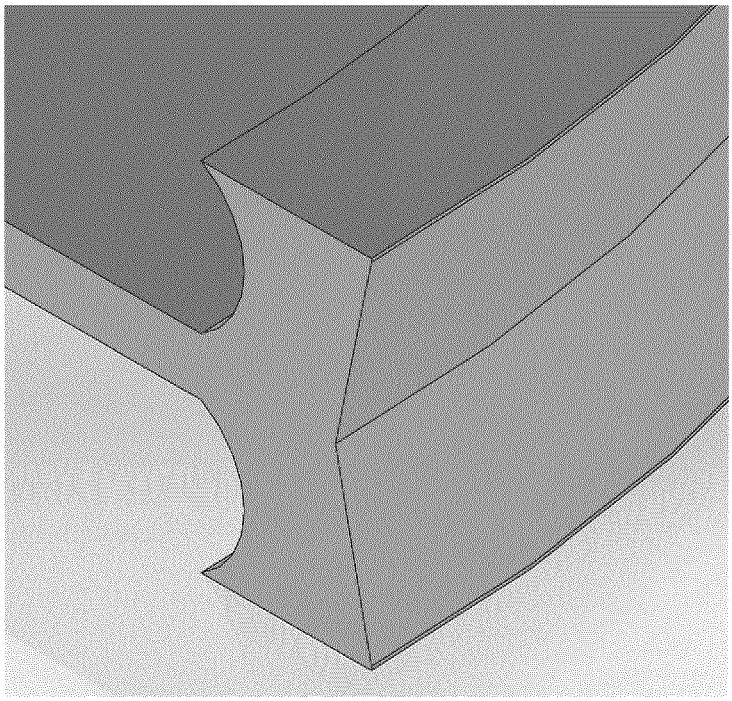
FIG. 14 is a perspective view of a separator with an angled concave outer wall.
Figure 15:
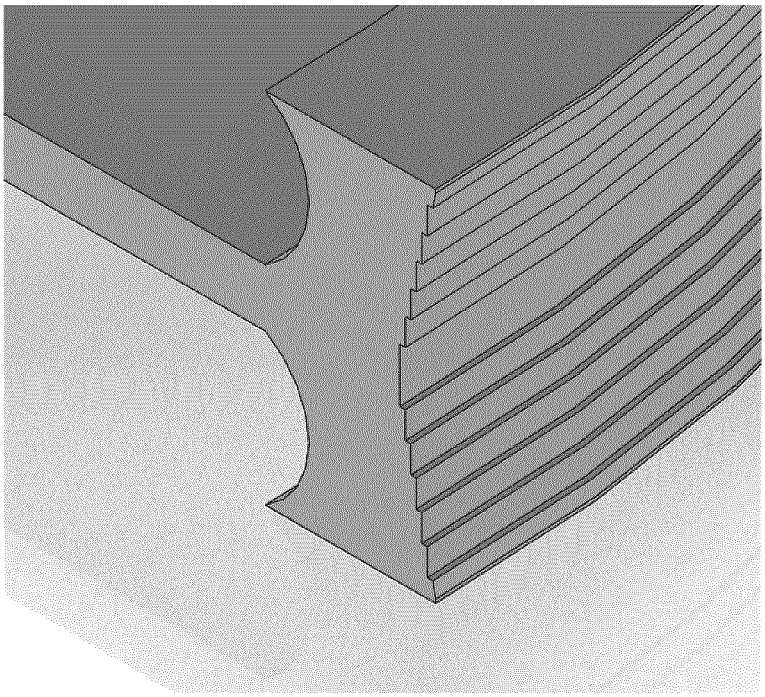
FIG. 15 is a perspective view of a separator with a serrated concave outer wall.
Figure 16:
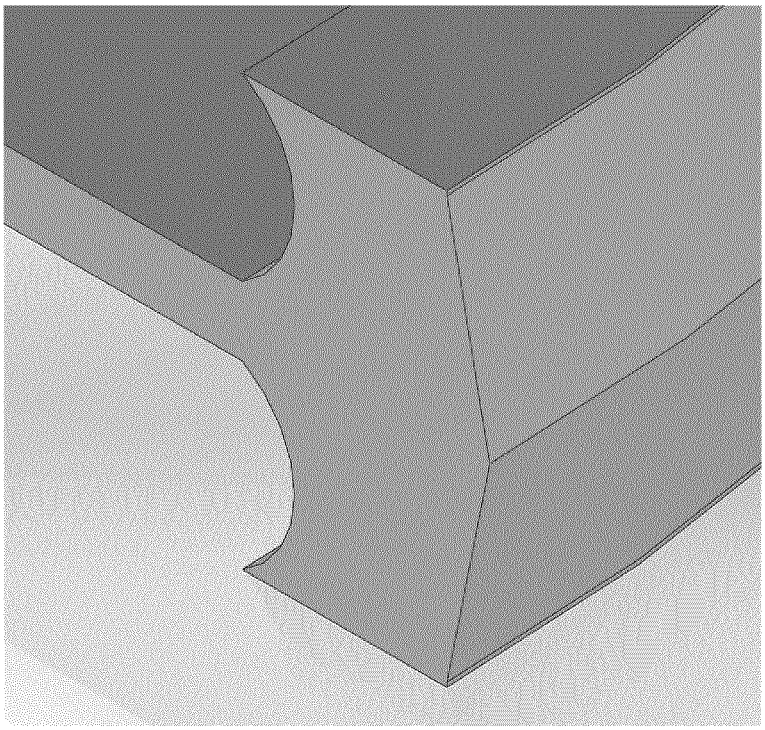
FIG. 16 is a perspective view of a separator with an angled convex outer wall.

As a further example, in contrast to prior art such as US2014/0144751, the flat geometry can be modified by adding specific geometrical features to the external circumferential surface of the metallic inserts as well as to the outer wall surface of the separator (2) for the purposes of locking during coining. The separator (2) may have a wall as shown in FIG. 10 that contains an undercut or negative draft of 5 degrees to hold the inserts. The negative draft allows the grooved inserts to be pre-assembled to the separator through a press-fit operation. After the press fit operation, the pre-assembled separator and inserts can be fed along with the outer ring for the final coining operation. The negative draft will provide a gap between the inserts and the separator (FIG. 11). With the proper coining dies, the gap as a result of the negative draft will be filled by the inserts, and the external groove in the inserts will be filled by the separator during the coining operation. Such a locking method is not detailed in US2014/0144751 nor is it possible to achieve in US2014/0144751 due to the inherent nature of the tri-metal structure.

Authentication Features

Embodiments comprising the electrically conductive outer ring (1) and inserts (3,4) with the dielectric separator (2) may be authenticated on the basis of frequency-dependent capacitance as described below. In lieu of frequency-dependent capacitance, authentication may be determined on the basis of frequency-dependent conductivity, where appropriate.

Authentication of such coins may be achieved by measuring at least one frequency-dependent capacitance value between at least one of the following portions of the composite coin structure; (i) between the two stacked inserts (3,4), (ii) between the first insert (3) and the outer ring (1), or (iii) between the second insert (4) and the outer ring (1). By generating up to three different frequency-dependent capacitance values between the metallic components, the structure can be authenticated when all three frequency dependent capacitance values meet a pre-determined target capacitance signature. One skilled in the art may vary the surface areas of the first insert (3) and second insert (4), the inner surface area of the outer ring (1), the inner diameter of the outer ring (1), the outer diameters of the inner inserts (3,4), the frequency dependent dielectric constant of the separator (2), and the dimensions of the separator (2) (as shown in FIG. 1C) to facilitate up to three independent capacitance measurements between the three metallic components.

In particular, the separator may or may not be included in the authentication process.

Figure 1C:
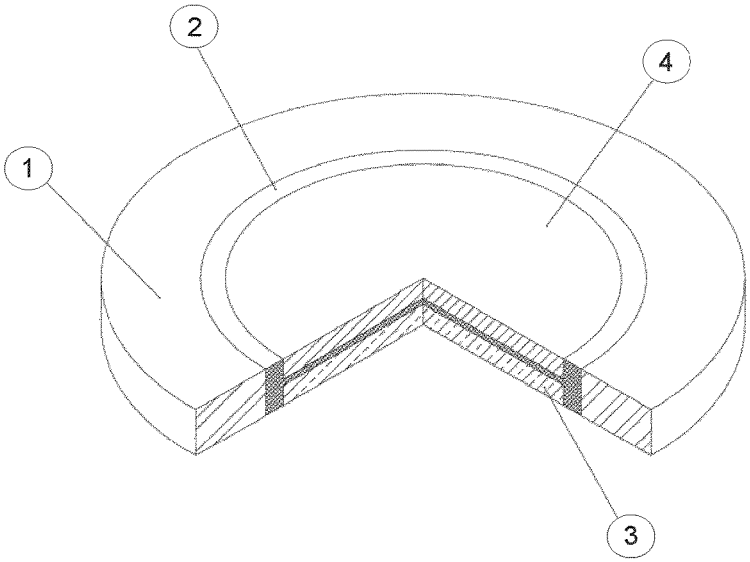
Figure 1D:
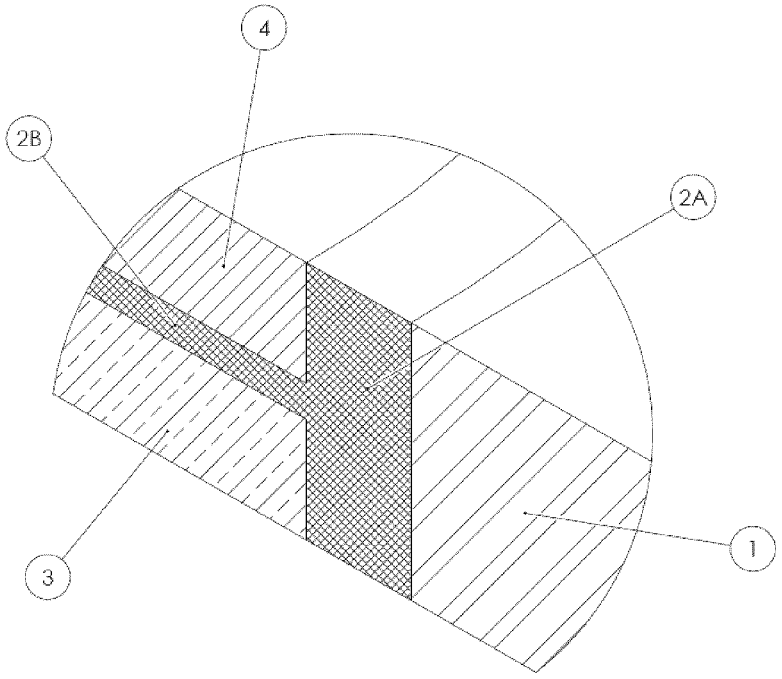
Figure 17:
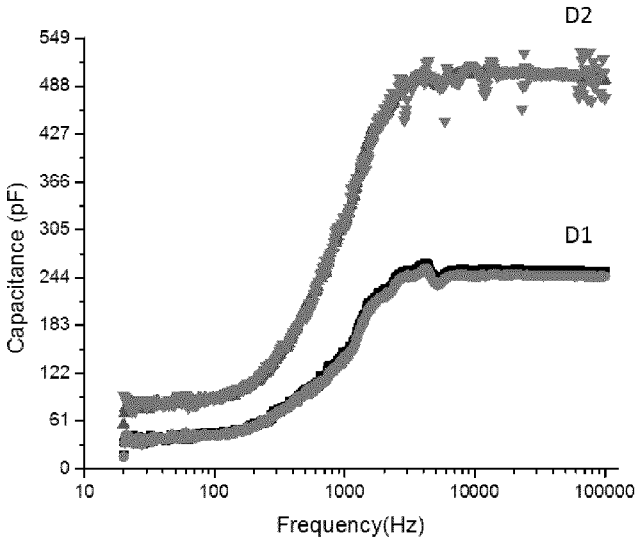
FIG. 17 is a graph showing capacitance vs. frequency for two different non-metallic separator materials (D1, D2) measured between a first insert a second insert of a composite coin structure.

For example, the dielectric constant of the separator in FIG. 1C has a value of 3.0 at 1 MHz such as that of but not limited to polysulfone. In a second embodiment, a coin of the same overall geometrical structure has a separator with a dielectric constant of 9.0 at 1 MHz such as but not limited to PVDF. When two probes are placed on either side of the stacked inserts (3,4) of the composite structure, the capacitance of the first embodiment (Dielectric=3) has a capacitance response that varies with frequency as shown in line D1 of FIG. 17. While the capacitance of the second coin embodiment (Dielectric=9) with the higher dielectric constant of the same dimensions has the capacitive response that varies with frequency as shown in line D2 of FIG. 17.

Figure 18:
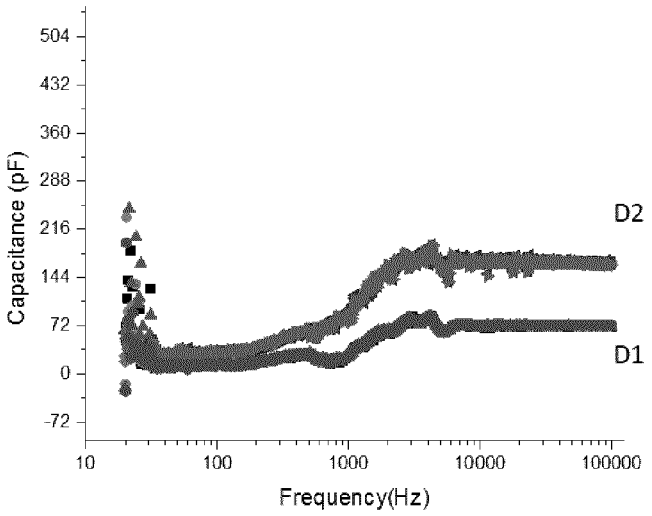
FIG. 18 is a graph showing capacitance vs. frequency for two different non-metallic separator materials (D1, D2) measured between a first insert and an outer ring, and between a second insert and outer ring wherein the inserts have the same outer diameter.

In another example, FIG. 18 indicates the capacitance between the first insert (3) of the inner stack and the outer ring (1) as well as the capacitance between the second insert (4) of the inner stack and the outer ring (1). A capacitor is generated between each insert (3 and 4) and the outer ring (1). A clear contrast between embodiments is measured due to the difference in dielectric constant of the separator where line D1 has a separator dielectric of 3, while line D2 has a separator dielectric of 9. In this embodiment, the two capacitance measurements between inserts (3,4) and the outer ring (1) are equivalent since the insert (3,4) geometries are equivalent. However, if one were to change the outer diameter of one of the inserts (3 or 4) as shown in FIG. 10, such that the two inserts (3,4) had different outer diameters, then an additional difference in capacitive response would occur between the outer ring (1) and each inner insert (3,4).

Such measurable difference in capacitance allows the composite structure to be authenticated as genuine. In the event of a counterfeit attempt, security is enhanced by the combination of authentication parameters that must be satisfied. In particular, for example, not only the physical dimensions, appearance, and conductivity of the metallic components must be correct, but the additional parameter of the dielectric properties of the separator must also be correct in order to authenticate the three frequency dependent capacitance values that exist within the composite coin structure. It is clearly shown that by varying the dielectric property of the separator (1), that the two composite coin structures may be distinguished.

One skilled in the art may vary the geometry of the separator (1) such that an aperture or radially varying geometry is present (for example, but not limited to, embodiments shown in FIG. 2). When an aperture is present in the separator (1), an air gap acts as a capacitive element since the dielectric constant of air is unity. Varying the separator geometry to vary the air gap dimensions allows one to vary the capacitive response of the composite coin structure.

One skilled in the art may also adjust the capacitance values between the metallic components of the coin structure by adding either series or parallel capacitive elements by changing the size of the aperture or thickness profile of the radially varying geometry to further tailor the capacitance values between the three metallic components.

In the same way as described above for capacitance measurement, an analogous measurement of electrical resistance between the inner stack and the outer ring (1) may also be performed given appropriate selection of separator (2) electrical conductivity properties and geometry. Additionally, an analogous measurement of impedance through the coin structure could be varied by varying the separator (2) geometry.

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

REFERENCES

Juds et al., U.S. Pat. No. 6,021,882.

Bilas et al., United States Patent Application Publication No. 2014/0144751.

Bilas et al., Canadian Patent No. 2,843,770.

Ielpo, U.S. Pat. No. 4,472,891.

Geiger, H., European Patent Application No. EP 1 136 958 A1.

Jones, U.S. Pat. No. 3,968,582.

Finch et al., United States Patent Application Publication No. 2006/0071425.

Valley, U.S. Pat. No. 5,676,376.

Ielpo et al., U.S. Pat. No. 5,094,922.

Meyer-Steffens et al. PCT Application Publication No. WO 2014/019961.

Lasset et al., U.S. Pat. No. 5,630,288.

Kim, W H U.S. Pat. No. 6,189,197.

Truong, H C U.S. Pat. No. 6,044,541.

Li, X., Canadian Patent No. 2,854,146.

Li, X., United States Patent Application Publication No. 2014/0295204.

Morita et al., United States Patent Application Publication No. 2004/0173434.

Seuster et al. Canadian Patent No. 2,092,941.

Meyer-Steffens et al. United States Patent Application Publication No. 2015/0201721.

What is claimed is:

1. A composite structure comprising:

an inner stack comprising a plurality of inserts stacked on top of each other and at least one of the plurality of inserts comprises a metallic material;

an outer ring annularly surrounding the inner stack, the outer ring comprising a metallic material; and a separator disposed between the outer ring and the inner stack separating the outer ring from the inner stack and separating the plurality of inserts from each other for retaining the inner stack within the outer ring.

2. The composite structure of claim 1, wherein the separator comprises a separator wall disposed between the outer ring and the inner stack, and defining an interior area housing the inner stack, the separator wall having an outer face and an inner face.

3. The composite structure of claim 2, wherein the separator comprises at least one divider disposed within the interior area.

4. The composite structure of claim 3, wherein the at least one divider separates the plurality of inserts from each other.

5. The composite structure of claim 2, wherein the inner face of the separator wall comprises at least one recess.

6. The composite structure of claim 1, wherein the separator comprises a polymeric, metallic, semi-metallic, glass, ceramic, or composite material.

7. The composite structure of claim 1, wherein the separator comprises a dielectric material.

8. The composite structure of claim 1, wherein the separator comprises a conductive material.

9. The composite structure of claim 1, wherein the separator comprises a semi-conductive material.

10. The composite structure of claim 1, wherein an outer circumferential surface of each of the plurality of inserts comprises at least one recess.

11. The composite structure of claim 1, wherein an inner circumferential surface of the outer ring comprises at least one recess.

12. The composite structure of claim 1, wherein the plurality of inserts and the separator are locked together by at least one recess formed in an outer circumferential surface of the plurality of inserts.

13. The composite structure of claim 1, wherein the separator and the outer ring are locked together by at least one recess formed in an outer circumferential surface of separator.

14. The composite structure of claim 1, wherein the separator and the outer ring are locked together by at least one recess formed in an inner circumferential surface of the outer ring.

15. The composite structure of claim 1, wherein the separator comprises at least one divider comprising at least one aperture and separating the plurality of inserts and defining a void between the plurality of inserts.

16. The composite structure of claim 15, wherein the at least one divider comprises at least one protrusion extending to at least one outer surface of the inner stack.

17. The composite structure of claim 1, wherein the separator is marked with at least one figure or symbol.

18. The composite structure of claim 1, wherein at least one insert is marked with at least one figure or symbol.

19. The composite structure of claim 1, wherein the separator comprises particles in micro or nano scale.

20. The composite structure of claim 1, wherein the separator is transparent.

21. The composite structure of claim 1, wherein the separator is translucent or opaque.

22. The composite structure of claim 1, wherein the separator is colorless.

23. The composite structure of claim 1, wherein the separator is colored.

24. The composite structure of claim 1, wherein the composite structure is a coin.

25. The composite structure of claim 1, wherein the composite structure is a coin blank.

26. The composite structure of claim 1, wherein the composite structure is a medal.

27. The composite structure of claim 1, wherein the composite structure is a token.

28. The composite structure of claim 1, wherein the composite structure is a chip.

29. The composite structure of claim 1, wherein the composite structure is a gaming chip.

30. The composite structure of claim 1, wherein the composite structure is a medallion.

31. The composite structure of claim 1, wherein the separator varies in cross-sectional area.

32. The composite structure of claim 15, wherein the separator comprises a major axis and at least one minor axis and defines the aperture as a circle.

33. The composite structure of claim 15, wherein the separator comprises a major axis and at least one minor axis and defines the aperture as non-circular.

* * * * *